United States Patent [19]

MacKinnon

[11] 4,302,346

[45] Nov. 24, 1981

[54] EROSION-INHIBITED FUNCTIONAL FLUID

[75] Inventor: Hugh S. MacKinnon, Oakland, Calif.

[73] Assignee: Chevron Research Company, San Francisco, Calif.

[21] Appl. No.: 53,111

[22] Filed: Jun. 28, 1979

[51] Int. Cl.[3] ..... C09K 3/00

[52] U.S. Cl. ..... 252/75; 252/78.1; 252/78.5

[58] Field of Search ..... 252/75, 78.5, 78.1

[56] References Cited

U.S. PATENT DOCUMENTS

| | | | |
|---|---|---|---|
| 3,649,721 | 3/1972 | Burrous et al. | 252/75 X |
| 3,679,587 | 7/1972 | Smith | 252/75 |
| 3,907,697 | 9/1975 | Burrous | 252/75 |

*Primary Examiner*—Mayer Weinblatt

*Attorney, Agent, or Firm*—D. A. Newell; J. J. DeYoung

[57] ABSTRACT

The addition of a small amount of a di- or trivalent metal salt of a perfluroalkane sulfonic acid or perfluroalkane disulfonic acid to an energy transmitting functional fluid greatly enhances the anti-erosion properties of the fluid.

8 Claims, 1 Drawing Figure

PERFLUOROALKANESULFONATE SALTS AS WALL CURRENT INHIBITORS

EROSION-INHIBITED FUNCTIONAL FLUID

BACKGROUND OF THE INVENTION

1. Field of the Invention

This invention relates to fluid compositions which are useful for transmitting power in hydraulic systems. Specifically, it relates to power transmission fluids having a tendency to cause erosion of hydraulic systems and a newly discovered means of controlling such erosion.

Organic phosphate ester fluids have been recognized for some time as advantageous for use as the power transmission medium in hydraulic systems. Such systems include recoil mechanisms, fluid-drive power transmissions, and aircraft hydraulic systems. In the latter, phosphate ester fluids find particular utility because of their special properties which include high viscosity index, low pour point, high lubricity, low toxicity, low density and low flammability. Thus, for some years, numerous types of aircraft, particularly commercial jet aircraft, have used phosphate ester fluids in their hydraulic systems. Other power transmission fluids which have been utilized include major or minor amounts of hydrocarbon oils, amides of phosphoric acid, silicate esters, silicones and polyphenyl ethers. Additives which perform special functions such as viscosity index improvement and foam inhibition are also present in these fluids.

The hydraulic systems of a typical modern aircraft contain a fluid reservoir, fluid lines and numerous hydraulic valves which actuate various moving parts of the aircraft such as the wing flaps, ailerons, rudder and landing gear. In order to function as precise control mechanisms, these valves often contain passages or orifices having clearances on the order of a few thousandths of an inch or less through which the hydraulic fluid must pass. In a number of instances, valve orifices have been found to be substantially eroded by the flow of hydraulic fluid. Erosion increases the size of the passage and reduces below tolerable limits the ability of the valve to serve as a precision control device. Many aircraft have experienced sagging wing flaps during landings and takeoffs as a result of valve erosion.

Early investigations indicated that the erosion was being caused by cavitation in the fluid as the fluid passed at high velocity from the high-pressure to the low-pressure side of the valve. The incorporation of water into the hydraulic fluid was found to inhibit the erosion, but continuing experience shows that a significant erosion problem remains.

Recent studies indicate that certain valve erosions are associated with the electrokinetic streaming current induced by the high velocity fluid flow.

2. Description of the Prior Art

A study of the problem attributing valve erosion to the streaming current induced by fluid flow is Beck et al, "Corrosion of Servovalves by an Electrokinetic Streaming Current", Boeing Scientific Research Document D1-82-0839 (September, 1969) and Beck et al, "Wear of Small Orifice by Streaming Current Driven Corrosion", Transactions of the ASME, Journal of Basic Engineering, pp. 782–791 (December, 1970). Efforts to control hydraulic valve erosion by treating the problem as one of cavitation in the fluid are described in Hampton, "The Problem of Cavitation Erosion In Aircraft Hydraulic Systems", Aircraft Engineering, XXXVIII, No. 12 (December, 1966). The Text, Organophosphorous Compounds, by Kosolapoff (Wiley, New York, 1950), describes methods or preparing organophosphorous derivatives. Several patents describe phosphate ester hydraulic fluids, including U.S. Pat. Nos. 2,636,861, 2,636,862, 2,894,911, 2,903,428, 3,036,012, 3,790,487, and 3,907,697.

U.S. Pat. No. 3,679,587 claims a phosphate hydraulic fluid stabilized by a small amount of an alkali metal salt of a perfluorinated alkylsulfonic acid.

SUMMARY OF THE INVENTION

An erosion inhibited phosphate ester based functional fluid comprising a major amount of a phosphate ester and from 10 to 50,000 parts per million by weight of phosphate ester of a perfluorinated anionic surfactant selected from the group consisting of the di and trivalent metal salts of a perfluoroalkane sulfonic acid or perfluoroalkane disulfonic acid wherein the alkane is from 1 to 18 carbon atoms.

DETAILED DESCRIPTION OF THE INVENTION

Figure 1:
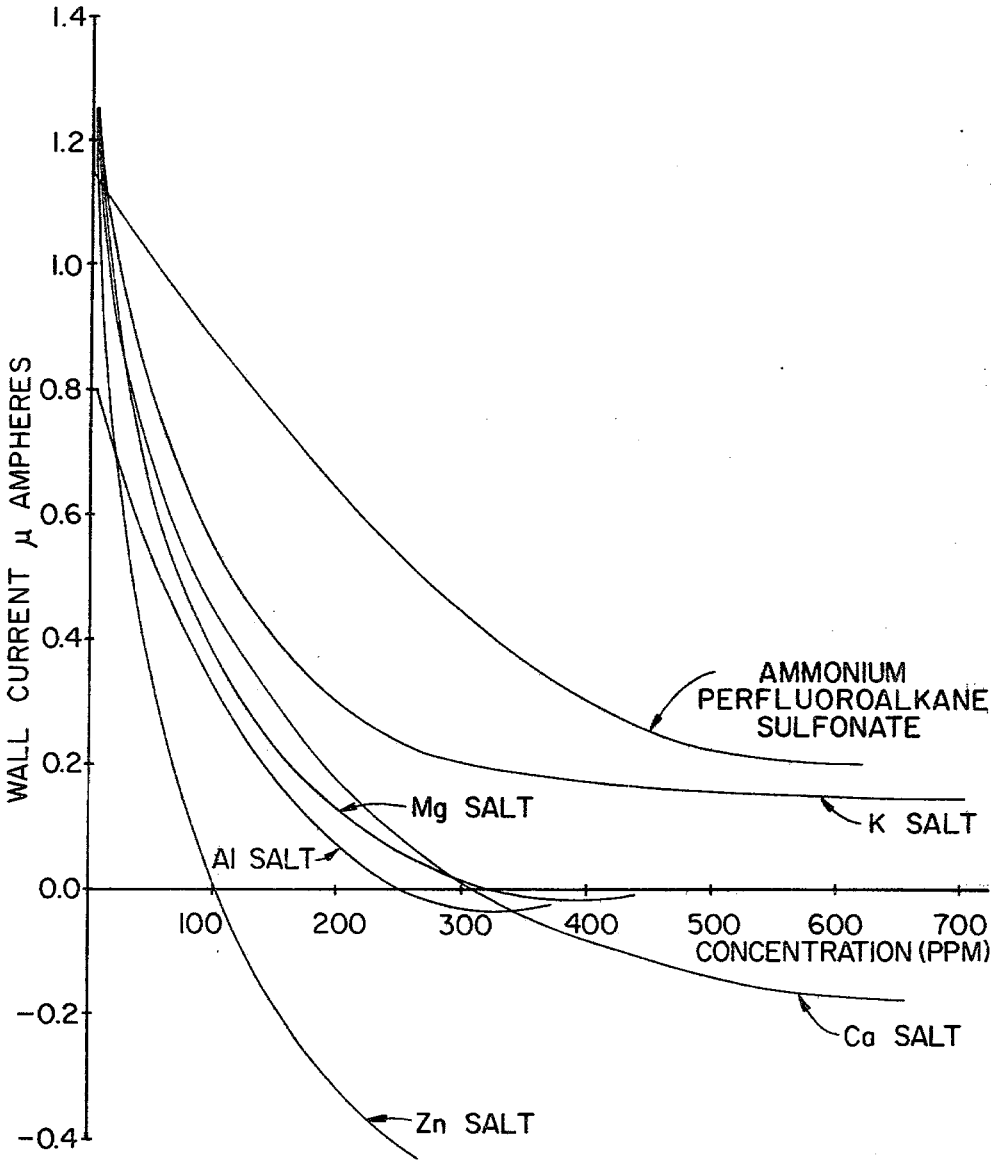

The present invention is an improvement over the invention disclosed in the aforementioned U.S. Pat. No. 3,679,587, the entire disclosure of which is incorporated herein by reference. It has been found that by incorporating into the fluid base an effective amount of a di- or trivalent metal salt of a perfluorosulfonic acid the anti-erosion properties of the composition are surprisingly superior to a fluid containing alkali metal salt.

Perfluorinated Anionic Surfactant

The perfluorinated anionic surfactants employed in the compositions of this invention are the polyvalent metal salts of perfluoroalkane sulfonic acids and have the general formula $$[R_fSO_3]_xM$$

where M is an di- or trivalent metal, for example beryllium, magnesium, calcium, zinc, cadmium, strontium, boron, aluminum, selenium or gallium, x is the valence of the metal, M, and is 2 or 3, and $R_f$ is a $C_nF_{2n+1}$ or a cyclic $C_aF_{2a-1}$ group where n is an integer of from 1 to 18 and a is an integer from 4 to 18. These salts are, for example, magnesium perfluoromethane sulfonate, calcium perfluoroethane sulfonate, calcium perfluorobutane sulfonate, zinc perfluorocyclohexane sulfonate, calcium perfluorooctane sulfonate, calcium perfluorooctadecane sulfonate, calcium perfluorocyclopentane sulfonate, calcium perfluoropentane sulfonate, and the like. It is preferred that the perfluorinated anionic surfactants contain at least 5 carbon atoms and especially preferred that they contain from 7 to 12 carbon atoms. Other perfluorinated anionic surfactants which can be employed in the composition of this invention are the di- or trivalent metal salts of perfluorinated alkane disulfonic acids and the like. These disulfonic acid salts are, for example, dicalcium perfluorododecane-1,2-disulfonate, $C_{12}F_{24}(SO_3Ca)_2X_2$ or calcium perfluorododecane-1,2-sulfonate, $C_{12}F_{24}(SO_3)_2Ca$, $$X^-Ca^+O_3S{-}C_{12}F_{24}{-}SO_3Ca^+X^-$$

or

-continued

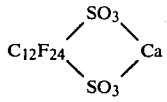

and the like, wherein $X^-$ is a monovalent anion.

The perfluorinated alkyl groups represented by $R_f$ include perfluorinated alkyl groups and perfluorinated cycloalkyl groups, for example, perfluoromethyl, perfluoroethyl, perfluoropropyl, perfluorobutyl, perfluoropentyl, perfluoroheptyl, perfluorooctyl, perfluorodecyl, perfluorooctodecyl, etc. The cycloalkyl groups are, for example, perfluorocyclopentyl, perfluorocyclohexyl, perfluorocycloheptyl, perfluoro-(ethylcyclohexyl), perfluoro(cyclohexylmethyl), perfluoro-(methylcyclohexyl), perfluoro(dimethylcyclohexyl) and the like. In order to have the surfactant properties and solubilities necessary for the compositions of this invention it is preferred that the perfluoroalkyl group contain at least 5 carbon atoms and even more preferred that it contain 7 or more carbon atoms.

The amount of the perfluorinated anionic surfactant employed in the functional fluid composition of this invention is from as little as 10 parts per million to as much as 50,000 parts per million by weight of the phosphate ester. Preferably the functional fluid contains at least 100 ppm and more preferably 200–500 ppm of the perfluorinated anionic surfactant. Amounts greater than 50,000 parts can be employed if soluble in the fluid, however, no commensurate advantages are obtained thereby.

Fluid Base

The power transmission fluid of the present invention comprises a fluid base present in major proportion in which the perfluorosulfonate salts and other additives are contained. The fluid base in which the additives of this invention are employed include a wide variety of base materials, such an organic esters of phosphorus acids, mineral oils, synthetic hydrocarbon oils, silicate esters, silicones, carboxylic acid esters, aromatics and aromatic halides, esters of polyhydric material, aromatic ethers, thioethers, etc.

The phosphate esters which are the preferred base fluid of the present invention have the formula

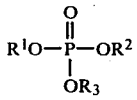

wherein $R^1$, $R^2$ and $R^3$ each represent an alkyl or aryl hydrocarbon group (As used herein, "aryl" includes aryl, alkaryl, and aralkyl structures and "alkyl" includes aliphatic and alicyclic structures.) All three groups may be the same, or all three different, or two groups may be alike and the third different. A typical fluid will contain at least one species of phosphate ester and usually will be a mixture of two or more species of phosphate esters.

The phosphate esters will each have a total carbon content of 3–36 carbon atoms. Individually alkyl groups will usually have 1–12 carbon atoms, while individual aryl groups will usually have 6–12 carbon atoms. Preferred esters contain 12–24 total carbon atoms, preferably alkyl groups, 4–6 carbon atoms, and preferred aryl groups, 6–9 carbon atoms. The alkyl groups may be straight- or branched-chain, with straight-chain, such as n-butyl, preferred. Similarly, the alkyl substituents in alkylaryl structures may also be straight- or branched-chain. Generic examples of the phosphate esters include trialkyl phosphates, triaryl phosphates and mixed alkylaryl phosphates. Specific examples include trimethyl phosphate, tributyl phosphate, dibutyloctyl phosphate, triphenyl phosphate, phenyl dicresyl phosphate, ethyl diphenyl phosphate, dibutylphenyl phosphate, tricresyl phosphate, etc.

In practice, phosphate ester fluid base generally contains several phosphate esters mixed together. Usually, one particular ester or several closely related esters will predominate. In a preferred type of fluid, the phosphate ester portion contains only trialkyl and triaryl phosphate esters, with the trialkyl phosphate esters predominating. Typically, the phosphate ester portion of this fluid will consist of 70–99 weight percent, preferably 80–92 weight percent trialkyl phosphate esters, with the remainder triaryl phosphate esters. The phosphate ester portion is normally 75–95 weight percent of the total fluid and preferably 85–95 weight percent.

Additives

The power transmission fluids of the present invention generally contain a number of additives which in total comprise 5–25 weight percent of the finished fluid. Among these is water, which may be added or often becomes incorporated into the fluid unintentionally. Such incorporation can occur when a hydraulic system is being refilled and is open to the atmosphere, particularly in humid environments. Unintentional incorporation of water may also occur during the manufacturing process of a phosphate fluid. In practice, it is recognized that water will be incorporated into the fluid and steps are taken to control the water content at a level in the range of 0.1–1 weight percent of the whole fluid. It is preferred that the water content be in the range of 0.1–0.8 weight percent and more preferably 0.2–0.6 weight percent.

Hydrolysis inhibitors to retard corrosion are often added to hydraulic fluids. They include various epoxides such as the glycidyl ethers described in U.S. Pat. No. 2,636,861. Typical epoxide compounds which may be used include glycidyl methyl ether, glycidyl isopropyl ether, styrene oxide, ethylene oxide, and epichlorohydrin. Hydrocarbon sulfides, especially hydrocarbon disulfides, such as dialkyl disulfide, are often used in combination with the epoxide compounds for additional corrosion suppression. Typical hydrocarbon disulfides include benzyl disulfide, butyl disulfide and diisoamyl disulfide. A particularly preferred class of epoxide hydrolysis inhibitors are those containing two linked cyclohexane groups to each of which is fused an epoxide (oxirane) group. Illustrative are those in which the linking structure contains a carboxylic acid ester group.

The hydraulic fluid normally contains 2–10 weight percent, preferably 5–10 weight percent, of one or more viscosity index improving agents such as alkyl styrene polymers, polymerized organic silicones, or preferably, polyisobutylene, or the polymerized alkyl esters of the acrylic acid series, particularly acrylic and methacrylic acid esters. These polymeric materials generally have a number average molecular weight of from about 2,000 to 300,000.

Measurements

It has been found that the rate of valve erosion in aircraft hydraulic system valves varies with the electrical streaming potential of the hydraulic fluid passing through the valve. Streaming potential is defined on pages 4–30 of the Electrical Engineers Handbook, by Pender and Del Mar (New York, Wiley, 1949). It is the EMF created when a liquid is forced by pressure through an orifice and is a function of factors such as the electrical properties and viscosity of the liquid, the applied pressure, and the physical characteristics of the orifice. Since the streaming potential is dependent on several factors, it is found that the streaming potential measurement of a given fluid on a given apparatus at a given time will vary over a small range. For this reason, the ordinary practice is to select as a standard a fluid which is considered to have acceptable erosive characteristics. Each day the apparatus is calibrated by measuring the streaming potential of the standard fluid and then comparing the streaming potential of the test fluids against this standard. The apparatus used to measure streaming potential is described in detail in the Beck et al report "Wear of Small Orifices by Streaming Current Driven Corrosion", referred to above. Measurements are taken at room temperature with the fluid pressure adjusted to 1,500 psi. For convenience, the streaming potential detected by the apparatus is impressed across a standard 100,000-ohm resistor to obtain a resultant current, which is reported as the "streaming current".

EXAMPLES

In the following examples the base stock consisted of 6.0% of a mixed polyalkylacrylate made from predominantly $C_6$ to $C_{10}$ alcohols in tributylphosphate containing 13.0% tri(isopropylphenyl)phosphate. To the base stock was added from 30 to 700 ppm of the following salts:

Magnesium perfluoroalkanesulfonate was prepared by the addition of ammonium perfluoroalkanesulfonate (FC93 3M Company) to magnesium metal in methanol;

Calcium perfluoroalkanesulfonate was prepared by the addition of ammonium perfluoroalkanesulfonate (FC93 3M Company) to calcium hydride in methanol;

Zinc perfluoroalkanesulfonate was prepared from ammonium perfluoroalkanesulfonate (FC93 3M Company) and zinc chloride; Aluminum perfluoroalkanesulfonate was prepared from ammonium perfluoroalkanesulfonate (FC93 3M Company) and aluminum chloride;

Potassium perfluoroalkanesulfonate (FC98 3M Company); and Ammonium perfluoroalkanesulfonate (FC93 3M Company).

The wall current was measured for numerous concentrations between 0 and 700 ppm and the composite results are shown by the curves in FIG. I. Comparision of the various curves in FIG. 1 shows that the di- and trivalent metal salts of the present invention are superior to the alkali metal salts of the prior art.

What is claimed is:

1. An erosion inhibited phosphate ester based functional fluid comprising a major amount of a phosphate ester and from 10 to 50,000 parts per million by weight of phosphate ester of a perfluorinated anionic surfactant selected from the group consisting of the di- and trivalent metal salts of a perfluroalkane sulfonic acid or perfluoroalkane disulfonic acid wherein the alkane is from 1 to 18 carbon atoms.

2. The composition of claim 1 wherein said metal salt is an alkaline earth metal salt.

3. The composition of claim 1 wherein said metal salt is a salt of magnesium, aluminum, calcium or zinc.

4. The composition of claim 1, in which the phosphate ester is a mixed alkylaryl phosphate.

5. The composition of claim 1, in which the phosphate ester is a mixture of trialkyl phosphate and triaryl phosphate.

6. The composition of claim 5, in which the trialkyl phosphate is tributyl phosphate and the triaryl phosphate is tricresyl phosphate or triisopropylplenyl phosphate.

7. The composition of claim 3 wherein said fluid contains 200 to 5000 parts per million of said surfactant.

8. In a method of operating a hydraulic device wherein a displacing force is transmitted to a displacing member by means of a functional fluid, the improvement which comprises employing as said fluid the composition of claims 1, 2, 3, 6 or 7.

* * * * *